US005195429A

United States Patent [19]

Firpo

[11] Patent Number: 5,195,429

[45] Date of Patent: Mar. 23, 1993

[54] ASSEMBLY FOR PERFORATING, CRUSHING AND BALING CRUSHABLE OBJECTS

[76] Inventor: Sergio E. Firpo, 338 S. Wisconsin, Oak Park, Ill. 60302

[21] Appl. No.: 924,409

[22] Filed: Aug. 3, 1992

Related U.S. Application Data

[63] Continuation of Ser. No. 662,479, Feb. 28, 1991, abandoned.

[51] Int. Cl.[5] ..... B30B 9/32

[52] U.S. Cl. ..... 100/96; 100/98 R; 100/156; 100/902; 241/99; 241/292.1

[58] Field of Search ..... 100/94–98 R, 100/156, 173, 902; 241/99, 242, 282.1, 243, 292.1

[56] References Cited

U.S. PATENT DOCUMENTS

| | | | |
|---|---|---|---|
| 1,013,509 | 1/1912 | Nelson | 241/242 |
| 1,598,364 | 8/1926 | Cassell et al. | 100/98 R X |
| 2,594,054 | 4/1952 | McNamara et al. | 100/173 |
| 3,749,004 | 7/1973 | Pagdin et al. | 100/902 X |
| 3,901,541 | 8/1975 | Peterson . | |
| 3,915,392 | 10/1975 | Kugler | 241/243 X |
| 4,121,514 | 10/1978 | Nickaloff | 100/902 X |
| 4,195,562 | 4/1980 | Mickler | 100/902 X |
| 4,358,995 | 11/1982 | Ballo et al. | 100/156 X |
| 4,601,238 | 7/1986 | Davis, Jr. et al. | 100/902 X |
| 4,787,495 | 11/1988 | Tuten et al. | 100/902 X |
| 4,987,829 | 1/1991 | Hudson et al. | 100/95 X |

FOREIGN PATENT DOCUMENTS

| | | | |
|---|---|---|---|
| 3803689 | 8/1989 | Fed. Rep. of Germany | 100/902 |

OTHER PUBLICATIONS

"Cram-A-Lot ® Downstroke Balers" for J. V. Manufacturing, Inc., no date.

"Selco Vertical Balers" for Mid-States Baler & Shear Systems, Inc. of the Harris Group, no date.

"The Best Baler Value" for GPI Division, Harmony Enterprises Inc., Aug. 1987.

"Turning Waste Into Profit With The . . . GPI M60MD Baler" for GPI Division, Harmony Enterprises Inc., no date.

"Perforator/Densifier Plastic Container Densifier" for Lummus Development Corp., no date.

"LDC Capabilities . . . " for Lummus Development Corp. and two sheets of drawings dated Mar. 8, 1990 and Nov. 13, 1989.

"Plastic Container Perforators" for Economy Baler Division, The American Baler Company, 1988.

"The Affordable Alternative in Meeting Today's Challenges for a Brighter Tomorrow" for NORPAC Compaction & Recycling Equipment, no date.

"Vertical Baler" for SP Industries, Inc., Jan. 1990.

"A 1990's Approach to Recycling Non-Ferrous Metals such as . . . Beverage Cans, Radiators, Scrap Aluminum" for Waste Recycler Mfg. Co., no date.

"V-6030 HP, V-4830 HP Recycler" for Marathon Equipment Company, Aug. 19889.

"Industrial High Density Hydraulic Baler" for Piqua Engineering Inc., no date.

Prodeva Model 700 Specification Sheet by Recycling Equipment & Service Company, Inc. dated May 11, 1990.

Labrie Top Select 2000 Plastic Crusher Specification Sheet and Drawings, no date.

*Primary Examiner*—Harvey C. Hornsby
*Assistant Examiner*—Stephen F. Gerrity
*Attorney, Agent, or Firm*—Tilton, Fallon, Lungmus & Chestnut

[57] ABSTRACT

An assembly for perforating, crushing and baling crushable objects includes a hopper for receiving crushable objects at a first location. A conveyor moves the crushable objects from the first location to a second location. At the second location, a perforating and crushing apparatus receives the crushable objects and perforates them while crushing them to a flat, plate-like configuration. The objects then move, under the force of gravity, to a baling apparatus which compresses the crushed objects into a bale of predetermined configuration.

11 Claims, 4 Drawing Sheets

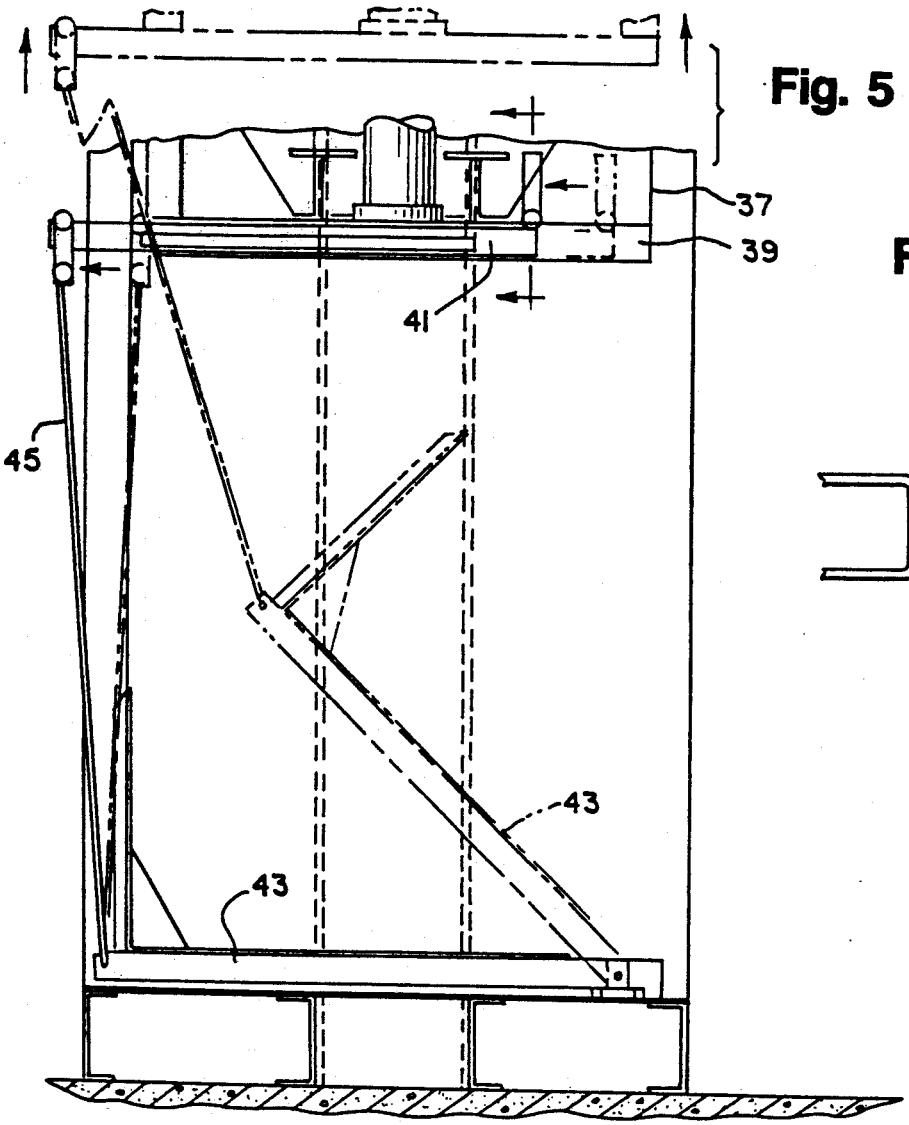
Fig. 5
Fig. 6
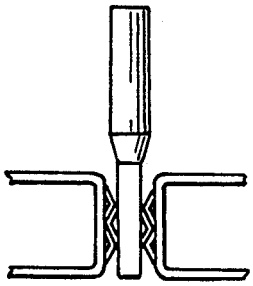
Fig. 7
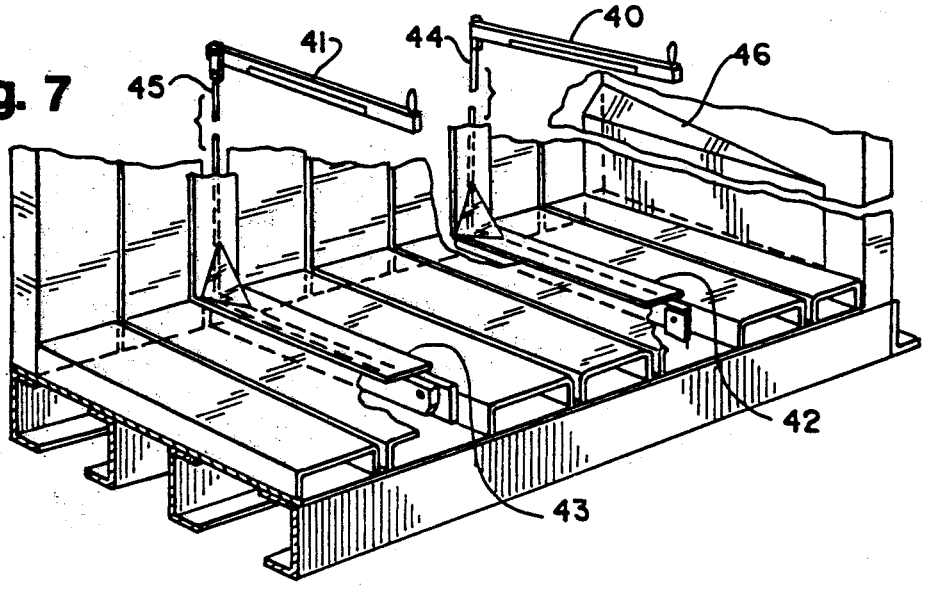

ASSEMBLY FOR PERFORATING, CRUSHING AND BALING CRUSHABLE OBJECTS

This application is a continuation of application Ser. No. 622,479, filed Feb. 28, 1991 (abandoned).

BACKGROUND OF THE INVENTION

1. Field Of The Invention

The present invention relates to an assembly for baling crushable objects such as plastic receptacles, and more particularly to an assembly for perforating, crushing and baling crushable objects into bales of a predetermined configuration. The present invention has particular utility for plastic containers, but it also has utility for other items, e.g. aluminum and paper containers.

2. Description Of The Prior Art

In recent years, the waste disposal and recycling industries have experienced tremendous growth. This growth has produced a wide variety of flattener/perforators and balers for reducing the volume of items such as aluminum cans, plastic containers, and cardboard boxes and facilitating the handling and transportation of those items.

The prior flattener/perforators and balers suffer many disadvantages. Some have complex constructions. Others have massive configurations which require large spaces for their installation and operation. Accordingly, manufacturing these prior devices requires unnecessary expense. Operating many of these devices involves labor-intensive, and thus expensive, methods and procedures.

The assembly of the present invention avoids the disadvantages of the prior art devices. It provides a simple, integrated system which quickly and efficiently perforates, crushes, and bales crushable objects. It provides a construction which greatly minimizes the expense of manufacture and assembly. It also minimizes the expense of operation.

SUMMARY OF THE INVENTION

In accordance with one embodiment of this invention, an assembly for perforating, crushing, and baling crushable objects includes a hopper disposed at a first location. The hopper defines an opening through which it receives crushable objects and another opening through which it discharges those objects.

A conveyor receives the crushable objects which discharge from the hopper at the first location. The conveyor is a cleated belt conveyor or any other suitable conveyor. It moves the crushable objects from the first location to a second location where it discharges them into a perforating and crushing apparatus.

The perforating and crushing apparatus includes a housing or frame which defines an opening through which the apparatus receives the crushable objects. It also includes a support member on which the crushable objects drop. This member is a curved plate hingedly connected at one end to the housing. Spring means bias the support member to a predetermined position where it co-acts with a cooperating member to crush or flatten the crushable objects.

The cooperating member includes a roller rotatably mounted to the housing. It also includes a plurality of perforating elements secured to the roller in rows which lie parallel to the axis of rotation of the roller. With its perforating elements, the cooperating member impales the crushable objects and moves them against the supporting member.

The cooperating member and the supporting member define a nip between each other. The distance between the support member and the cooperating member decreases to a minimum at the nip. This feature produces tangential feeding to facilitate the movement of the crushable objects through the nip. As the crushable objects move through the nip, the support and cooperating members crush or flatten them. After moving through the nip, the crushed objects discharge out of the perforating and crushing apparatus through an outlet which communicates with an inlet in a baling apparatus.

The baling apparatus includes a housing which defines the inlet through which the objects move into the assembly. The crushable objects drop to the bottom of the housing and collect there. A platen member mounted for reciprocating movement in the housing compresses the objects after they have filled the bottom of the housing to a predetermined level.

The platen member includes at least one hook member disposed in sliding relation with the platen member and movable between a first position in which it lies within the periphery of the platen member and a second position in which a portion of it extends outwardly of the platen member.

After the baler compresses crushed objects to a predetermined level, an operator moves the hook member to the second position and, using a cable or a chain connects the hook member, and thus the platen, with a corresponding ejecting bar pivotally mounted at one end to the front portion of the baler housing floor. By raising the platen, the operator pivots the ejecting bar about its pivot axis and dislodges the bale of objects which the bottom of the baler housing defines. At least one wall insert secured to a bottom portion of a side wall of the receptacle baler housing facilitates the removal of a bale from the housing. It has a wedge-like shape with the sharp end disposed proximate the front of the housing and the wide end at the back.

BRIEF DESCRIPTION OF THE DRAWINGS

For a more complete understanding of this invention one should now refer to the embodiment illustrated in greater detail in the accompanying drawings and described below by way of an example of the invention. In the drawings:

FIG. 5 is a partial, side elevation view of the baling apparatus of the present invention.

FIG. 6 is a front elevation view of a hook member disposed in the platen member of the baling apparatus.

FIG. 7 is a partial perspective view of the bottom of the housing of the baling apparatus of the present invention.

While the following disclosure describes the invention in connection with an embodiment, one should understand that the invention is not limited to this embodiment. Furthermore, one should understand that the drawings are not to scale and that graphic symbols, diagrammatic representations, and fragmentary views in part illustrate the embodiment. In certain instances, the disclosure may not include details which are not necessary for an understanding of the present invention, such as conventional details of fabrication and assembly.

DETAILED DESCRIPTION OF THE DRAWINGS AND AN EMBODIMENT

Figure 1:
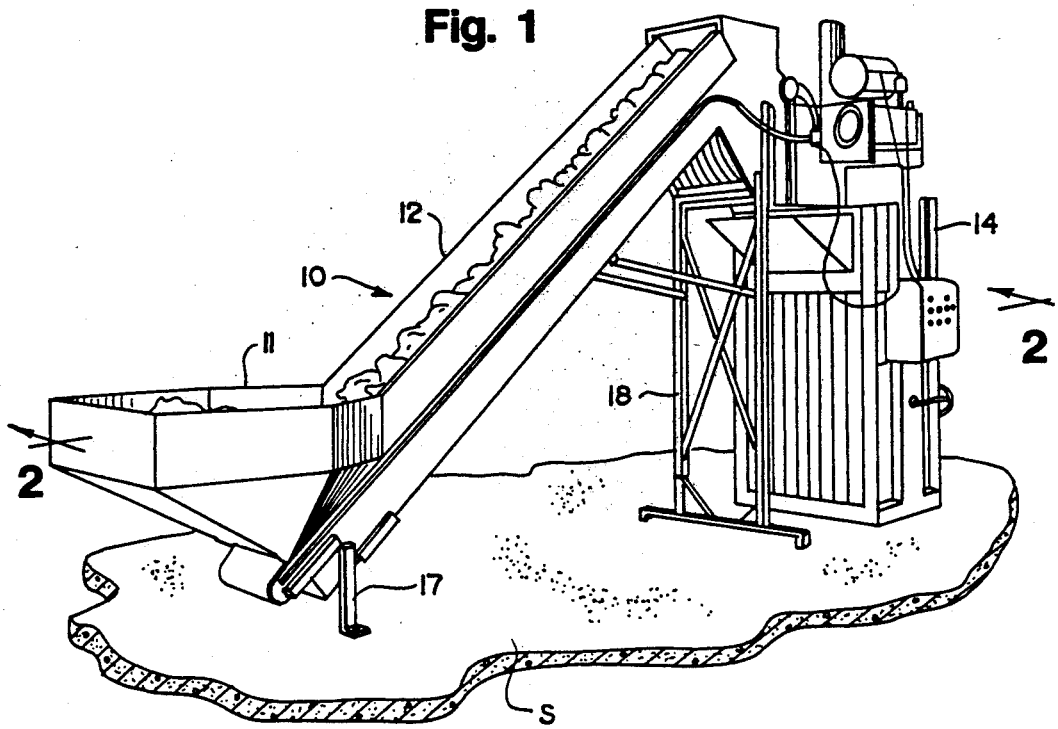
FIG. 1 is a perspective view of a perforating, crushing and baling assembly that employs the present invention.
Figure 2:
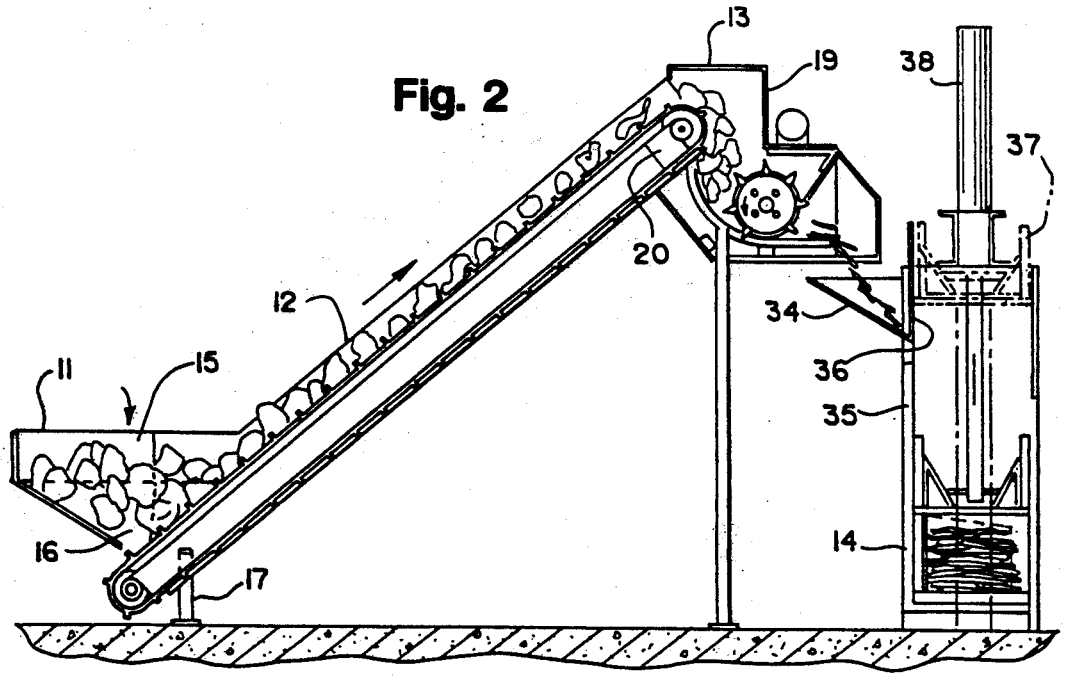
FIG. 2 is a sectional view taken along line 2—2 in FIG. 1.

Turning now to the drawings, FIGS. 1 and 2 show the perforating, crushing and baling assembly of the present invention at 10. This assembly 10 generally includes a hopper 11, a conveyor 12, a perforating and crushing apparatus 13, and a vertical baling apparatus 14. The structural components of this assembly are made of sheet metal or any other material of high strength and rigidity.

The hopper 11 defines an enlarged opening 15 at the top and it has a sloping bottom which directs crushable objects such as plastic containers to a discharge outlet 16 and onto the conveyor 12. The hopper has sufficient capacity to allow continuous feeding of crushable objects to the perforating and crushing apparatus 13 and to the baling apparatus 14.

The conveyor 12 is a cleated belt conveyor or any other suitable conveyor. It lies at an acute angle to a supporting surface S with one end disposed below the hopper 11 proximate the surface S and the second end elevated a substantial distance above the surface S. A frame 17 supports the first end of the conveyor, while a frame 18 and the housing 19 of the perforating and crushing apparatus 13 support the other, opposite end. A fixed-speed conveyor drive 20 drives the conveyor. It lies mounted on the housing 19 and includes a motor, a gear reducer and a chain and sprocket transmission.

Figure 3:
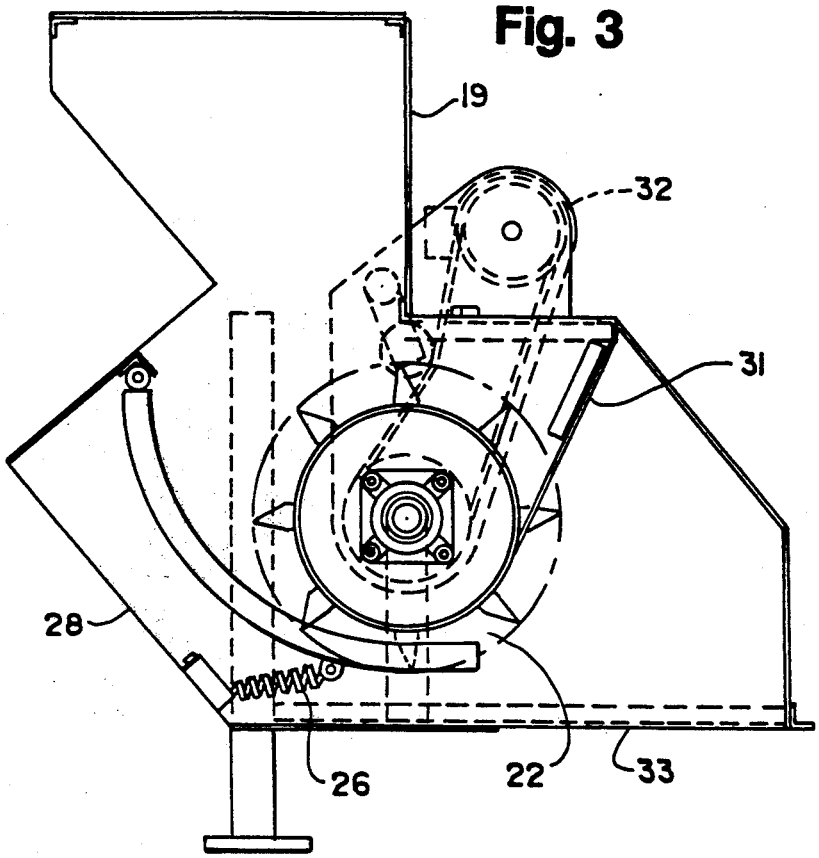
FIG. 3 is an enlarged sectional view of the perforating and crushing apparatus of the present invention.
Figure 4:
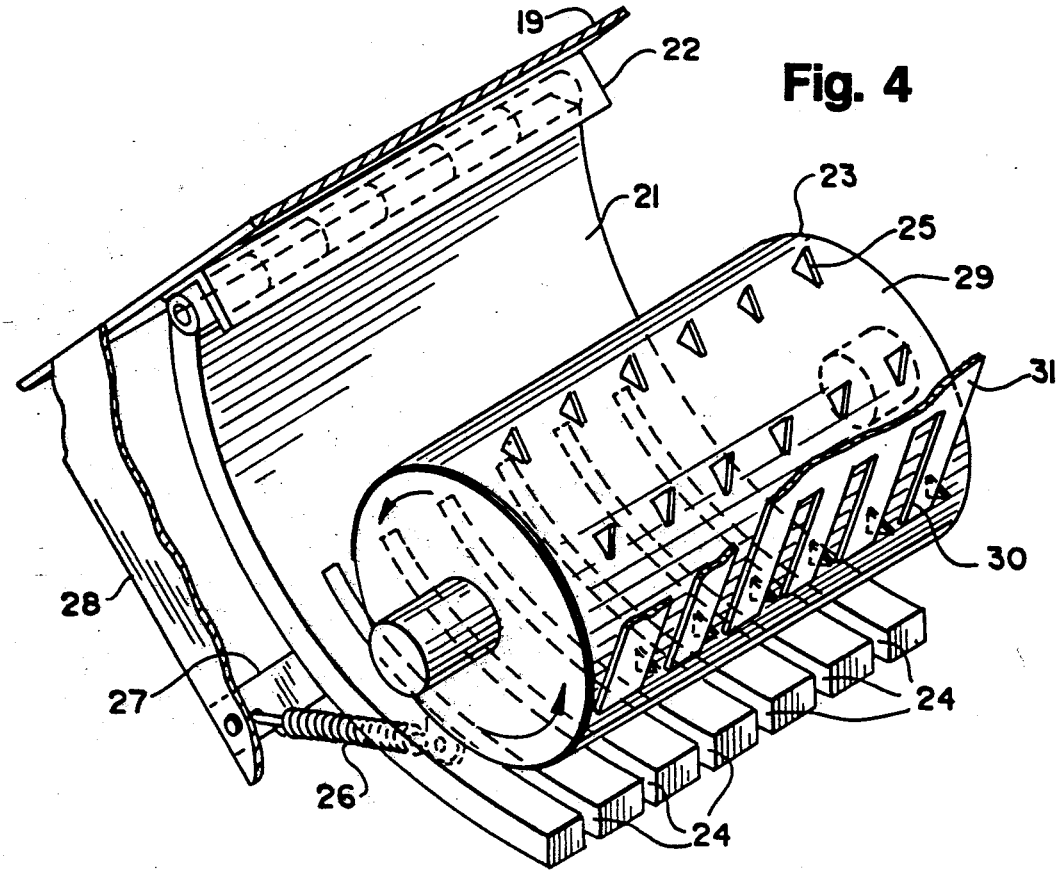
FIG. 4 is an enlarged partial perspective view of the perforating and crushing apparatus.
Figure 9:
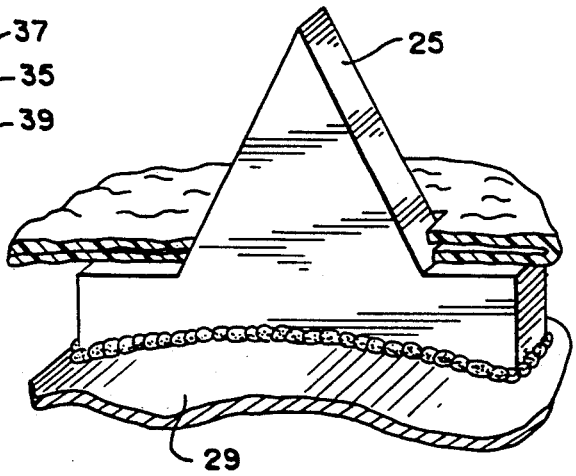
FIG. 9 is a partial perspective view of a perforating element of the perforating and crushing apparatus.

Turning now to FIGS. 3, 4, and 9, the perforating crushing apparatus 13 includes the housing 19 and a support member 21 hingedly secured at one end to the housing 19, as at 22. This member is a curved plate which receives crushable objects and directs them towards a crushing or flattening nip 23 which it and a cooperating member 23 define. The plate 21 defines a plurality of slots 24 which allow perforating elements 25 of the cooperating member 23 to move past the plate, as described below.

A spring assembly 26 biases or loads the plate 21 in a predetermined position (See FIGS. 3 and 4). In the embodiment shown, the spring assembly 26 includes four compression springs. Each compression spring includes a central threaded rod, two telescoping bronze bushings and a connecting fork. One end of the spring lies pivotally mounted to the plate 21 and the other lies pivotally connected to a transverse beam 27. Bolts or other conventional securing devices releasably secure the beam 27 to the sidewalls of the housing 19 (See FIG. 4) and allow adjustment of the beam along the edge 28 of the housing 19. By raising and lowering the beam along this edge 28, one may adjust the nip 22, i.e.. the distance between the plate 21 and the cooperating member 23.

The cooperating member 23 includes a drum or roller 29 and rows of the perforating elements 25 which lie parallel to the axis of rotation of the drum 29 and to each other. Welds or other suitable connecting means fixedly secure the elements 25 to the outer surface of the drum 29 (See FIG. 9). The elements of individual rows lie spaced apart a predetermined distance. The rows have the same number of puncturing elements aligned with the elements of the adjacent rows without any circumferential staggering. This alignment allows the elements to move through the slots 24 of the plate 21 without engaging the plate 21. It also allows the elements to move through a plurality of slots 30 defined by a scraper plate 31 (See FIG. 3).

The plate 31 lies, welded or otherwise secured to the housing 29, tangentially of the roller 21, as shown in FIG. 3. It has a comb-like configuration; and it scrapes or dislodges crushable objects impaled on the perforating elements 25. Although the elements 25 have a configuration which facilitates release of the objects (See FIG. 9), some objects nevertheless remain on the drum; and the wiper plate 31 removes them.

As shown in FIG. 3, the distance between the plate 21 and the cooperating member 23 decreases to a minimum at the nip 22. This feature produces tangential feeding to facilitate the movement of the crushable objects through the nip under the force of the roller 29. (A drive 32, including a motor, a motor reducer, a chain and sprocket transmission and an idler sprocket, drives the roller 29, counterclockwise in FIG. 3.) As the crushable objects move through the nip, the plate and cooperating member crush or flatten them. The spring assembly 26 maintains a predetermined crushing pressure, while allowing the plate 21 to move away from the drum 29 when a non-crushable object moves through the nip 22. After moving through the nip 22, the crushed objects discharged out of the perforating and crushing apparatus 13 through an outlet 33 defined by the housing 19. The perforations in the objects minimize the entrapped air in the objects which might help the objects recover their shape.

A receiving hopper 34 at the back of the baling apparatus 14 (shown in FIGS. 5–8) receives the crushed objects from the apparatus 13 and directs them into a housing 35 of the apparatus 14 through an opening 36 at the rear, top portion of the housing. The crushed and perforated objects fall to the floor of the housing 35. During collection of the objects, the front door **35*a* of the housing remains closed to prevent the objects from moving out of the apparatus 14**.

A platen member 37 disposed in the housing 34 for reciprocating movement between a lowered position (shown in solid lines in FIG. 2) and a raised position (shown in phantom lines in FIG. 2) compresses the crushed objects into a bale. It includes a plate-like portion 39 (See FIG. 5) which engages the crushed objects. A hydraulic cylinder 38 drives the platen member 37 up and down in the housing 35.

The platen portion 39 defines slots at opposite ends which receive hook members 40 and 41 (See FIG. 6). These hook members are elongate bars with a handle secured to one end and a notch formed at the other end. As shown in FIG. 6, the handles extend out of the slots so that an operator may grasp the handles and move the hook members back and forth in the slots.

With these handles an operator may move the hook members between a retracted and extended positions shown in FIG. 5. In the retracted position partially shown in phantom lines in FIG. 5, the hook members lie substantially within the outer periphery of the platen portion 39 and allow the platen member to move between its raised and lowered positions without engaging any cross members of the housing 35. In the extended position shown in solid lines in FIG. 5, the portion of the hook member which defines the notch extends outwardly of the platen portion 39 through a slot in the back wall of the housing 35 to allow an operator to connect the platen member 37 with a pair of ejecting bars 42 and 43.

The ejecting bars 42 and 43 have a generally L shaped configuration. One leg of each bar lies in a slot defined by structural elements of the floor of the baling apparatus housing. A pivot connection pivotally connects the front end of this leg to the front portion of the floor. A cable or chain 44 connects the other end of the leg for the ejecting bar 42 to the hook member 40; and a cable or chain 45 connects the other end of the leg for the ejecting bar 42 to the hook member 41. (The cables make these connections only during the ejecting procedure discussed below.)

By raising the platen member 37 a short distance (so that the hook members do not engage a cross member of the housing 35), the apparatus 14 moves the bars 42 and 43 to the position shown in phantom in FIG. 5; and the bale of crushed objects drops out of the housing 35 through the front opening of the housing. Wall inserts 46 and 47 having a wedge-like configuration and fixedly secured (e.g., welded) to the sidewalls of the housing 35 below the lower limit of the platen's displacement, facilitate the removal of the bale from the housing 35.

Figure 8:
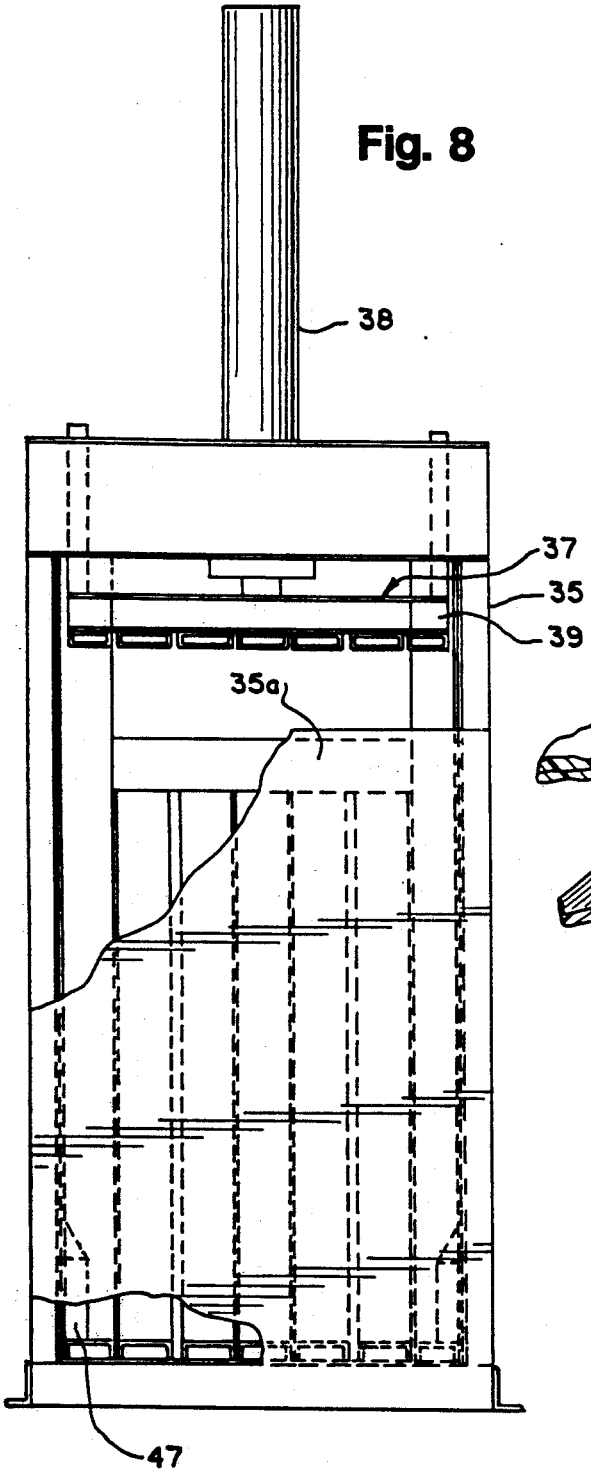
FIG. 8 is a front elevation view of the baling apparatus with the front door panel partially broken away.

As shown in FIGS. 7 and 8, elongate structural members form the back wall and the floor of the housing 35 of the baling apparatus 14. Gaps between these members or elements allow free movement of the hook members and the ejecting bars. They also allow the placement of securing bands around the bales. Specifically, before the assembly 10 begins forming a bale, an operator may place bands through these slots across the floor of the housing; the apparatus forms the bale; and the operator then moves the bands around the bale and secures them before the assembly ejects it.

In operation, the assembly 10 receives crushable objects in the hopper 11; and the conveyor 12 continually feeds those objects to the perforating and crushing assembly 13 which flattens them and feeds them to the baler 14. During these operations, the controls of the assembly 10 maintain the platen in the raised position, shown in phantom in FIG. 2. Once the housing 35 has filled to a predetermined level, the controls stop the conveyor and the perforating and crushing apparatus. (The controls can determine when the housing has filled to a predetermined level with a photoelectric sensing device.) The controls then move the platen member 37 downwardly to a location slightly above the wall inserts 46 and 47, thus compacting the crushed objects which have dropped into the housing 35.

The controls then raise the platen 37 and begin a new cycle. The assembly 10 continues to perform these cycles until it has formed a complete bale. The platen then moves to a position shown in FIG. 5 where an operator connects the hook members with the ejecting bars, using cables 44 and 45. The platen member then rises to the position shown in phantom in FIG. 5 and discharges the bale of crushed objects out of the housing 35.

While the above description and the drawings disclose and illustrate one embodiment, one should understand, of course, that the invention is not limited to this embodiment. Those skilled in the art to which the invention pertains may make modifications and other embodiments employing the principles of this invention, particularly upon considering the foregoing teachings. Therefore, by the appended claims, the applicant intends to cover any such modifications and other embodiments as incorporate those features which constitute the essential features of this invention.

What is claimed is:

1. An assembly for baling crushable objects, said assembly comprising: a hopper for receiving crushable objects, said hopper defining an opening through which it receives the crushable objects; first means for crushing and perforating the crushable objects; conveyor means disposed between the hopper and the first means for conveying the crushable objects from the hopper to the first means; and baling means disposed proximate the first means for receiving the crushed and perforated objects and compressing them into a predetermined shape; said first means including: a frame, a support member pivotally mounted to the frame, springs means secured to the frame for biasing the support member to a predetermined position, a cooperating member rotatably mounted on the frame and including a plurality of perforating elements for impaling the crushable objects, said cooperating member co-acting with the support member to crush and impale the crushable objects, and drive means disposed on the frame for rotating the cooperating member, said support member defining openings through which the perforating elements pass; each perforating element being flat and having a generally triangular penetrating portion defining an edge for penetrating the crushable objects, the perforating element also having a generally oblong base portion secured to the cooperating member for supporting the crushable object way away from the cooperating member.

2. The assembly of claim 1, wherein the support member is a plate with a curved configuration, and wherein the support member and the cooperating member define a nip.

3. The assembly of claim 2, wherein the spring means adjusts the distance between the support member and the cooperating member at the nip.

4. The assembly of claim 1, further comprising a wiper member secured to the frame for removing any curshable objects stuck to the cooperating member.

5. The assembly of claim 4, wherein the wiper member defines openings through which the perforating elements pass.

6. The assembly of claim 5, wherein the perforating elements lie spaced apart at constant predetermined distances and register with the openings in the support and wiper members as the cooperating member rotates.

7. A crushing and perforating apparatus for crushable objects comprising: a frame; a support member pivotally mounted to the frame; spring means secured to the frame for biasing the support member to a predetermined position; a cooperating member rotatably mounted on the frame and including a plurality of perforating elements for impaling the crushable objects, said cooperating member co-acting with the support member to crush and impale the crushable objects; and drive means disposed on the frame for rotating the cooperating member; said support member defining openings through which the perforating elements pass; each perforating element being flat and having a generally triangular penetrating portion defining an edge for penetrating the crushable objects, the perforating element also having a generally oblong base portion secured to the cooperating member for supporting the crushable object away from the cooperating member; the cooperating member being round and tubular and defining a nip with the support member; the support member being a curved plate to direct the crushable objects to the nip.

8. The apparatus of claim 7, wherein the spring means adjusts the distance between the support member and the cooperating member at the nip.

9. The apparatus of claim 7 further comprising a wiper member secured to the frame for removing any crushable objects stuck to the cooperating member.

10. The apparatus of claim 9, wherein the wiper member defines openings through which the perforating elements pass.

11. The apparatus of claim 10, wherein the perforating elements lie spaced apart at constant predetermined distances and register with the openings in the support and wiper members as the cooperating member rotates.

* * * * *